US006203334B1

(12) United States Patent
Daoud et al.

(10) Patent No.: US 6,203,334 B1
(45) Date of Patent: Mar. 20, 2001

(54) MODULAR JACK RECEPTACLE INCLUDING A REMOVABLE INTERFACE

(75) Inventors: Bassel H. Daoud, Parsippany; Christopher M. Helmstetter, Bridgewater; David S. Kerr, Morris Plains; Walter Pelosi, Randolph; Mikhail Sumetskiy, Bridgewater, all of NJ (US)

(73) Assignee: Avaya Technology Corp., Miami Lakes, FL (US)

( * ) Notice: Subject to any disclaimer, the term of this patent is extended or adjusted under 35 U.S.C. 154(b) by 0 days.

(21) Appl. No.: 09/339,360

(22) Filed: Jun. 23, 1999

(51) Int. Cl.[7] ..... H01R 12/00
(52) U.S. Cl. ..... 439/76.1; 439/676; 379/399
(58) Field of Search ..... 439/76.1, 676; 379/438, 399, 325, 326, 327, 328

(56) References Cited

U.S. PATENT DOCUMENTS 4,220,391 * 9/1980 Krolak et al. ..... 439/676
4,756,695 * 7/1988 Lane et al. ..... 439/76.1
5,074,801 * 12/1991 Siemon ..... 439/188

* cited by examiner

*Primary Examiner*—Brian Sircus
*Assistant Examiner*—T. C. Patel
(74) *Attorney, Agent, or Firm*—Stroock & Stroock & Lavan LLP

(57) ABSTRACT

A modular jack receptacle that includes a plurality of removable interfaces that provide for interconnection between and among the plurality of interfaces and a modular jack held by the receptacle. Each of the removable interfaces include two terminals mounted on a printed circuit board and each connected to a circuit trace. Each interface may also include, as a routine matter of design choice, electronic devices, circuits, connectors, etc., to provide for additional functionality of the interface. The modular jack receptacle provides increased flexibility in diagnostic and test capability for a particular communication line from a Central Office (CO) to a customer premise location and simplified replacement of electronic devices installed in series with a communication line.

34 Claims, 5 Drawing Sheets

MODULAR JACK RECEPTACLE INCLUDING A REMOVABLE INTERFACE

FIELD OF THE INVENTION

The present invention relates to modular jack receptacles and, more particularly, to a modular jack receptacle including a removable interface that obviates the need to hard-wire test and diagnostic equipment in-line with the modular jack, and that provides greater flexibility in the placement and upgrade of electronic equipment placed in-line with the modular jack.

BACKGROUND OF THE INVENTION

When providing voice and/or data service from a Central Office (CO) to Customer Premise Equipment (CPE), a building entrance protector (BEP) having a plurality of modular jacks may be provided at the CPE and serves as the point of demarcation between the service provider and customer premise location. Equipment (including wiring) located on the customer side of the BEP is the customer's responsibility, and equipment (including wiring) located on the CO side of the BEP is the service provider's responsibility.

A modular jack is typically provided for each communication line from the service provider, and each line may also include an electronic device such as, for example, a maintenance test unit (MTU) or a half-ringer, hard-wired at the BEP in the line and in series with the modular jack. To diagnose a problem on a particular line from the CO to the customer premise location, the service provider can execute diagnostic tests remotely (i.e., from the CO) to activate the in-line electronics device. With this hard-wired configuration, only a single type of electronic device may be provided in each line from the CO. Moreover, replacement and/or upgrade of an existing in-line electronic device requires that the existing device be severed from the line and a new device be hard-wired in its place. This process can be both time-consuming and expensive.

It is thus desirable to provide a means for inserting and removing an electronic device from a communication line that overcomes the above-described shortcomings of the prior art.

SUMMARY OF THE INVENTION

The present invention is directed to a modular jack receptacle that includes a plurality of removable interfaces that provide for interconnection between and among the plurality of interfaces and a modular jack held by the receptacle.

In a preferred embodiment, the present invention is directed to a modular jack receptacle adapted to accept and hold a modular jack that includes a terminal. The modular jack receptacle comprises a housing having an aperture for accepting the modular jack. A first interface provided in the housing includes a first connector for making an electronic connection to the modular jack terminal when the modular jack is held within the receptacle. A second interface is provided in the housing and includes a second connector for making an electronic connection to the first connector when the second interface is placed within the housing, thus establishing an electronic connection between the modular jack and the second interface.

The present invention is also directed to a system for evaluating a communication line provided between a central office (CO) and a customer premise location. The CO may include communications equipment for communicating a signal from the CO to the customer premise location over the communications line, and the system comprises a modular jack receptacle adapted to accept and hold a modular jack that includes a terminal. The modular jack receptacle is located at the customer premise location and connected to the communication line. The receptacle comprises a housing having an aperture for accepting the modular jack and a first interface provided in the housing and including a first connector for making an electronic connection to the modular jack terminal when the modular jack is held within the modular jack receptacle. A second interface is provided that is removably placeable in the housing and includes a second connector for making an electronic connection to the first connector when the second interface is placed within the housing. The second interface further comprises electronic circuits, devices, connectors, etc. adapted for receiving the signal communicated from the CO and for communicating a return signal to the CO in response to the received signal.

Other objects and features of the present invention will become apparent from the following detailed description, considered in conjunction with the accompanying drawing figures. It is to be understood, however, that the drawings, which are not to scale, are designed solely for the purpose of illustration and not as a definition of the limits of the invention, for which reference should be made to the appended claims.

BRIEF DESCRIPTION OF THE DRAWINGS

In the drawing figures, which are not to scale, and which are merely illustrative, and wherein like reference characters denote similar elements throughout the several views.

DETAILED DESCRIPTION OF THE PRESENTLY PREFERRED EMBODIMENTS

The present invention is directed to a modular jack receptacle that includes a plurality of removable interfaces that provide for interconnection between and among the plurality of interfaces and a modular jack held by the receptacle. Each of the removable interfaces include two terminals mounted on a printed wiring board (PWB) and each connected to a circuit trace. Each interface may also include, as a routine matter of design choice, electronic devices, circuits, connectors, etc., to provide for additional functionality of the interface. The modular jack receptacle of the present invention provides increased flexibility in diagnostic and test capability for a particular communication line from a CO to a customer premise location and simplified replacement of electronic devices installed in series with a communication line (e.g., diagnostic devices (MTUS, half-ringers, etc.)).

Figure 1:
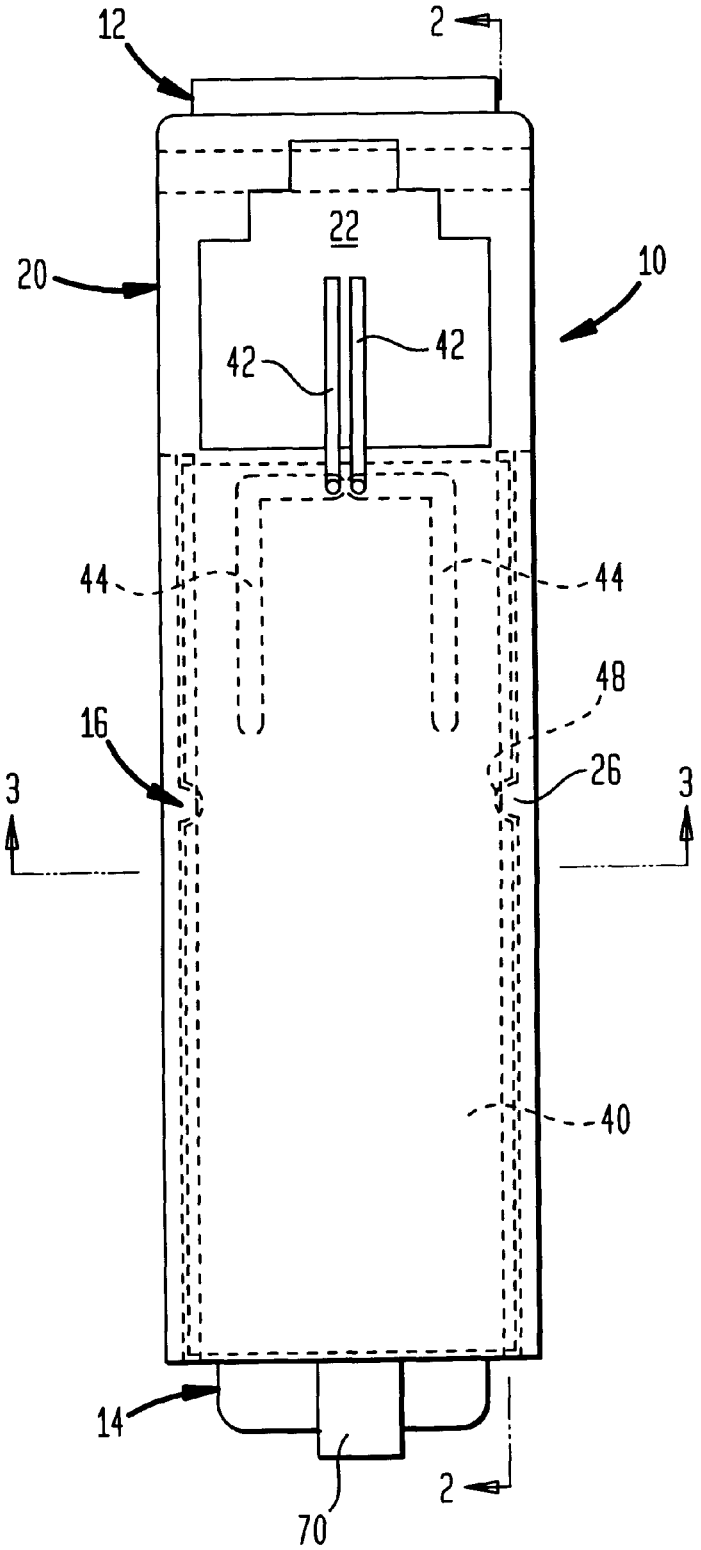
FIG. 1 is a front view of a modular jack receptacle constructed in accordance with the present invention.

Referring now to the drawings in detail, a modular jack receptacle 10 constructed in accordance with the present invention is depicted in FIG. 1. The receptacle 10 may be provided as part of a building entrance protector (BEP) 122 (see, e.g., FIG. 8) or at virtually any point in a communications network (voice, data, voice/data, etc.) 130 (see, e.g., FIG. 8) in which a modular jack and receptacle are provided. Thus, the detailed description provided herein and directed primarily to a communication link between a service provider (i.e., a Central Office (CO)) and a customer (i.e., Customer Premise Equipment (CPE)) is provided as an illustrative, non-limiting example. The modular jack receptacle of the present invention may be used in place of any modular jack receptacle, regardless of the size of the modular jack (e.g., RJ11, RJ45, etc.) or the type of communications network to provide the ability to tap into a link in the network without having to sever or otherwise disrupt the link.

Figure 2:
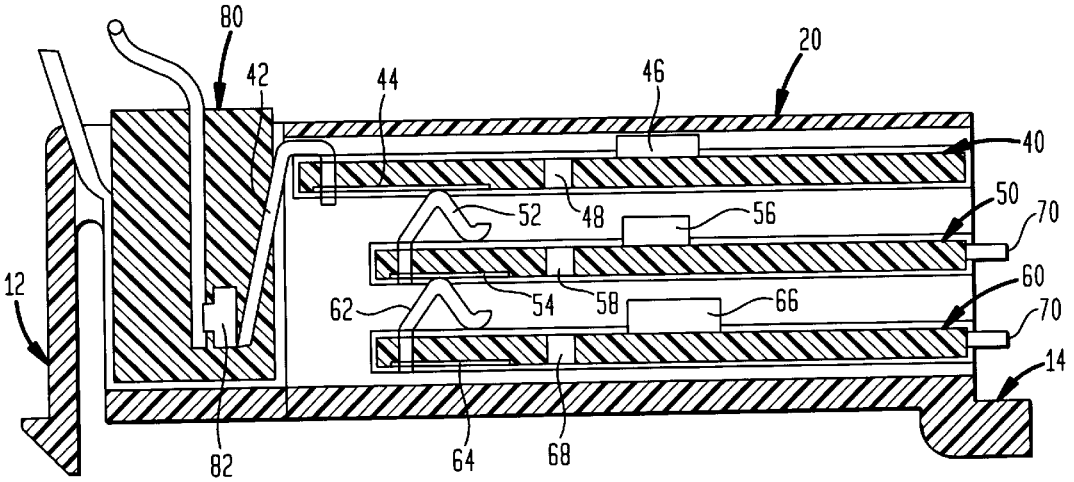
FIG. 2 is a cross-sectional view of the modular jack receptacle of FIG. 1 taken along the line 2—2.

The receptacle 10 depicted in FIG. 1 includes a housing 20 having an aperture 22 defined therein that is sized and shaped to accept and hold a modular jack 80 (see, e.g., FIG. 2) in place in the receptacle 10. The modular jack 80 includes a plurality of terminals 82, one of which is depicted in FIG. 2. Each jack terminal 82 contacts a receptacle terminal 42 when the modular jack 80 is held in place in the housing 20. A pliable retainer 12 and a rigid retainer 14 may be provided with the housing 20 to releasably secure the housing 20 in place in the BEP 122 or other device or equipment.

Figure 3:
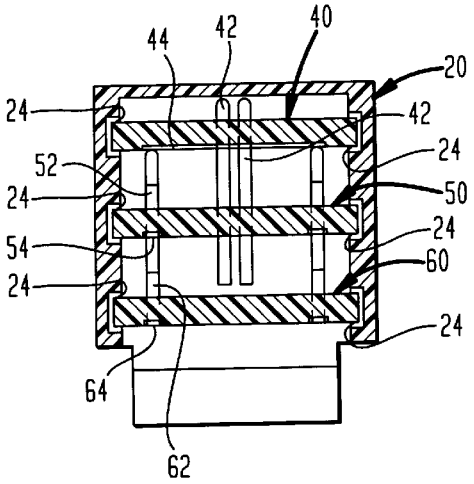
FIG. 3 is a cross-sectional view of the modular jack receptacle of FIG. 1 taken along the line 3—3.

Referring next to FIGS. 2 and 3, in which the modular jack receptacle 10 of the present invention is depicted in cross-section, a plurality of interfaces 40, 50, 60 are held in separate channels or guides 24 defined in the housing 20. Each interface 40, 50, 60 comprises a printed wiring board (PWB) 41, 51, 61 and may include electronics 46, 56, 66 to provide a predetermined functionality for an interface 40, 50, 60. For example, an interface may include electronics that provide the functionality of a maintenance test unit (MTU), a half-ringer, or virtually any other known or hereafter developed circuit, depending upon the desired functionality of the interface. Each interface 40, 50, 60 may also include an external connector 70 to provide an electronic path between the interface 40, 50, 60 and an external device, circuit, system, etc. The interfaces 40, 50, 60 are preferably selectively removable from the housing 20, although interface 40 may not be removable, as a routine matter of design choice.

A retainer 16 separately secures each interface 40, 50, 60 within the housing 20 and may comprise virtually any complementary features that would releasably secure the interfaces 40, 50, 60 in place. In a preferred embodiment, the retainer 16 comprises a protuberance 26 defined in each guide 24 and a detent 48 sized and shaped to accommodate the protuberance 26 and defined in each PWB 41, 51, 61.

Figure 4:
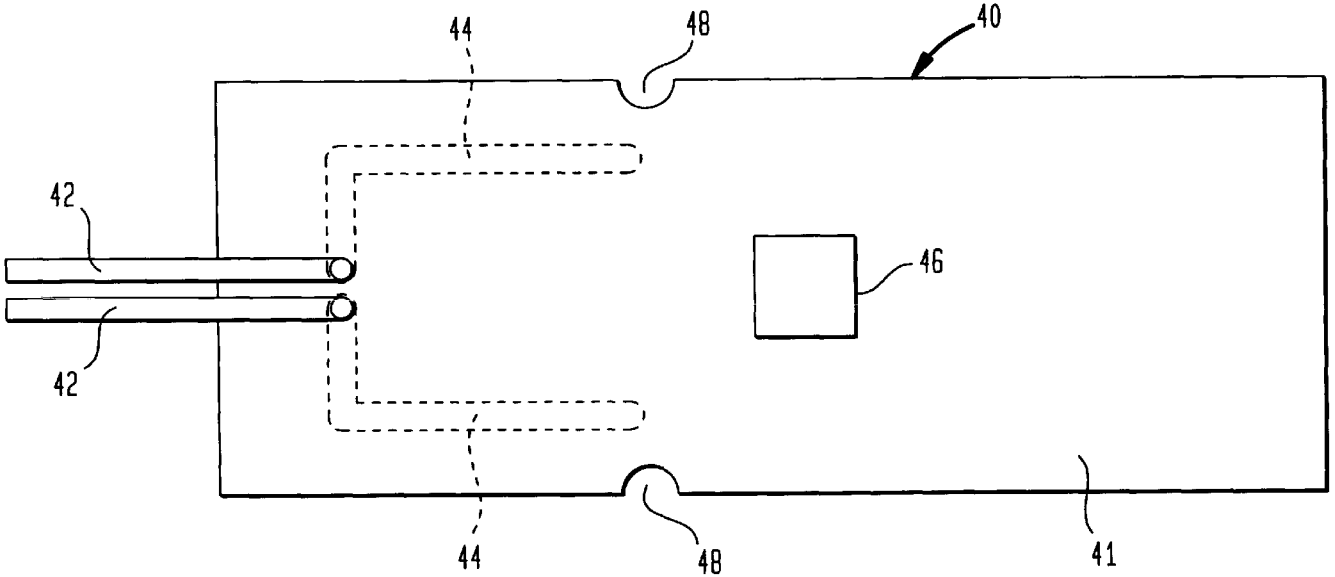
FIG. 4 is a top view of a first interface that includes two terminals for connection to a modular jack.
Figure 5:
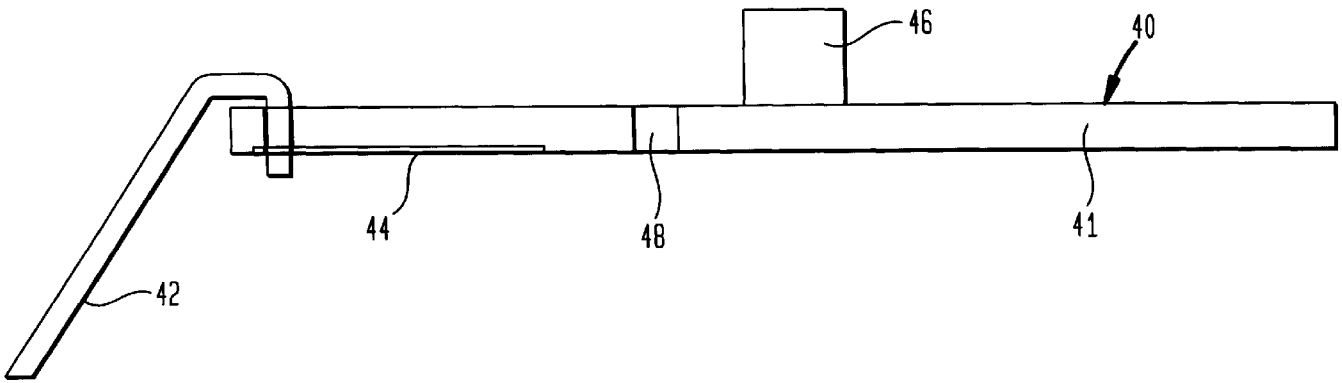
FIG. 5 is a side-view of the interface of FIG. 4.
Figure 6:
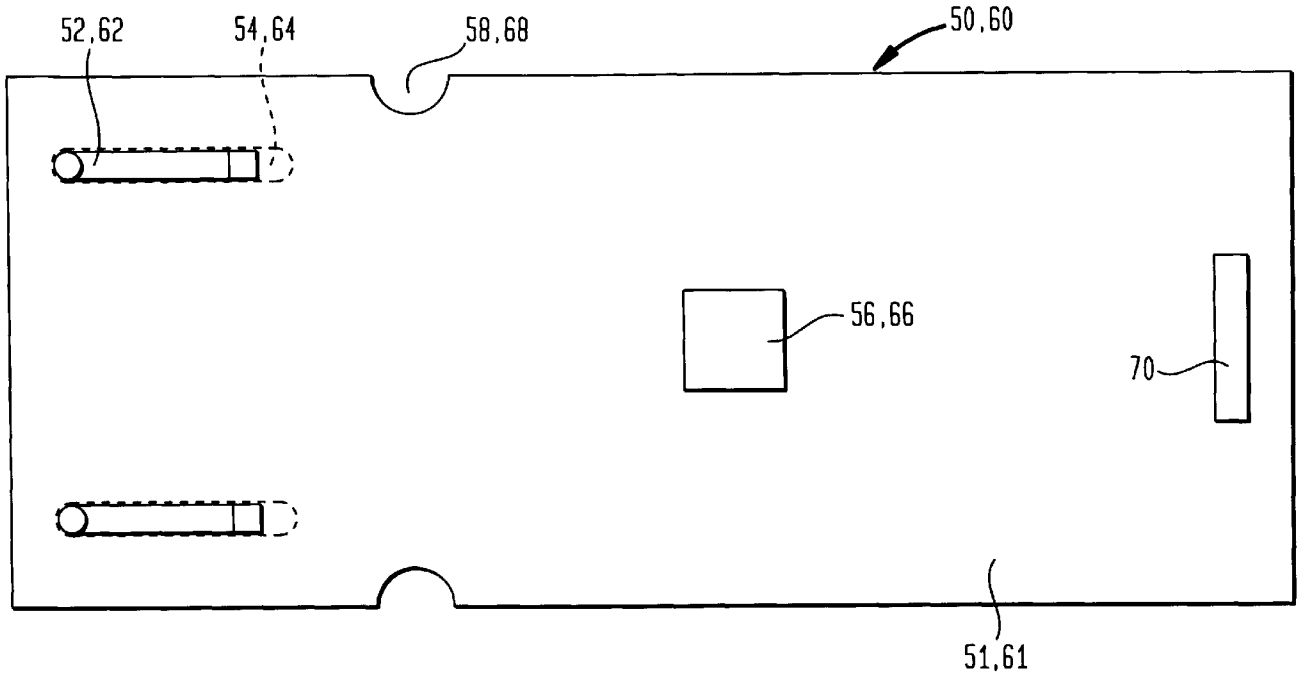
FIG. 6 is a top view of a second interface that is removably placeable in the housing of the modular jack receptacle of the present invention and that includes two terminals for connection to the first interface.
Figure 7:
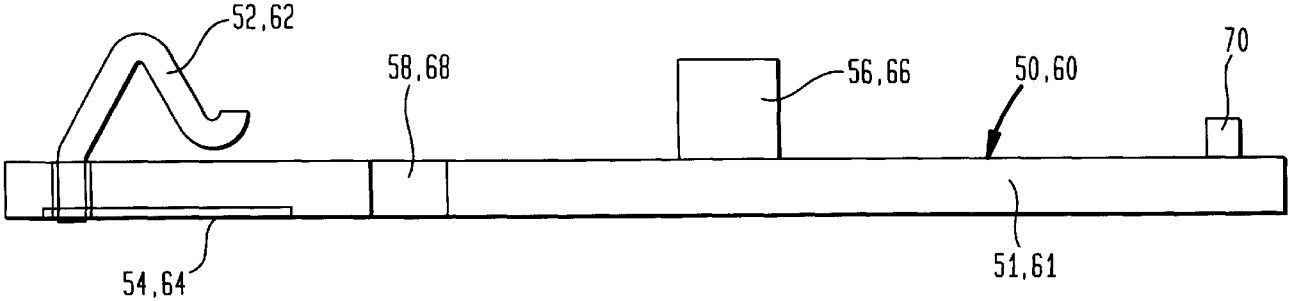
FIG. 7 is a side-view of the interface of FIG. 6.

A first interface 40, depicted in FIGS. 2, 4 and 5, includes two terminals 42 connected to two separate circuit traces 44 defined on the PWB 41. The terminals 42 are positioned on the PWB 41 so that when a modular jack 80 is inserted into the housing 20 and the first interface 40 is in place within the housing 20, the modular jack terminals 82 separately contact the interface terminals 42. The circuit traces 44 of the first interface 40 are positioned on the PWB 41 so that when a second interface 50 is provided (see, e.g., FIG. 2), the interface terminals 52 of the second interface 50 contact the circuit traces 44 of the first interface 40. In this way, an electronic connection may be established between the modular jack terminals 82 and the second interface 50 (via the first interface 40). Similarly, the circuit traces 54 provided on the second interface 50 are positioned so that when a third interface 60 is provided (see, e.g., FIG. 2), the interface terminals 62 of the third interface 60 contact the circuit traces 54 of the second interface 50. Thus, an electrical connection may be established between the modular jack terminals 82 and the third interface 60 (via the first and second interfaces 40, 50). If desired, an external connector 70 may be provided on any of the interfaces to facilitate connection between the respective interface and an external device, circuit, system, etc. In addition, electronics 46, 56, 66 may be provided on any of the interfaces 40, 50, 60, as a routine matter of design choice to provide a desired functionality for the interface.

The first interface 40 also eliminates the need for a so-called 645 insert, which is necessarily now provided with modular jack receptacles.

Although the figures and description provided herein are directed to a modular jack receptacle having three removable interfaces, more or less interfaces are also contemplated by the present invention.

Figure 8:
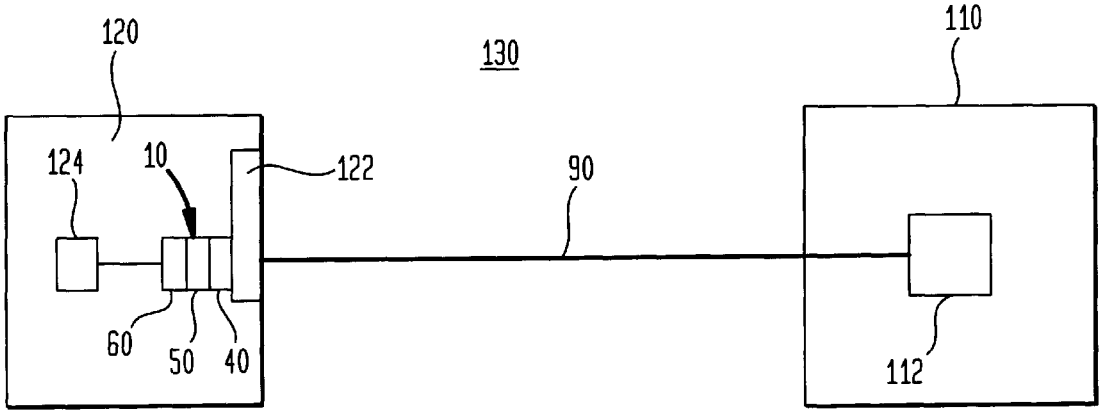
FIG. 8 is a schematic view of a communications network including a Central Office and a customer premise location having a BEP equipped with a modular jack receptacle constructed in accordance with the present invention.

Any of the second and third interfaces 50, 60 may be removed without affecting the communication line 90 (see, e.g., FIG. 8). Thus, an interface may be replaced for whatever reason without having to sever the communications line and insert a new interface.

Referring next to FIG. 8, a communications network 130 is schematically depicted and includes a central office (CO) 110 having installed therein communications equipment 112 that may include, by way of non-limiting example, a voice switch, a data switch, test/diagnostic equipment, computers, and various other electronic hardware and software devices and systems generally known in the art. A communication line 90 extends from the CO 110 to a customer premise location 120 that includes a building entrance protector (BEP) 122 having a modular jack receptacle 10 constructed in accordance with the present invention and connected between the communication line 90 and customer premise equipment (CPE) 124. The receptacle 10 includes a plurality of interfaces 40, 50, 60 that provide various interconnection and test/diagnostic functionality, or other functionality, as desired. The communications equipment 112 may communicate with the customer premise equipment 124 and may, for example, initiate and control and electronics provided on any of the interfaces 40, 50, 60 to diagnose the communications line 90. The interfaces 40, 50, 60 may include electronic circuits, devices, connectors, firmware, etc. adapted to receive a signal communicated from the communications equipment 112 and the communicate a signal to the CO 110 in response to the received signal. The signal communicated by the interface electronics 46, 56, 66 may indicate, for example, the condition of the communication line 90, e.g., open circuit, short circuit, over-current, etc. The interface electronics 46, 56, 66 may comprise, by way of non-limiting example a maintenance test unit, a half-ringer, or other know electronics devices.

Thus, while there have been shown and described and pointed out fundamental novel features of the invention as applied to preferred embodiments thereof, it will be understood that various omissions and substitutions and changes in the form and details of the disclosed invention may be made by those skilled in the art without departing from the spirit of the invention. It is the intention, therefore, to be limited only as indicated by the scope of the claims appended hereto.

What is claimed is:

1. A modular jack receptacle adapted to accept and hold a modular jack that includes a terminal, said modular jack receptacle comprising:

a housing having an aperture for accepting the modular jack;

a first interface provided in said housing and including a first connector for making an electronic connection to the modular jack terminal when the modular jack is held within said modular jack receptacle; and a second interface removably placeable in said housing and including a second connector for making an electronic connection to the modular jack terminal via said first connector when said second interface is placed within said housing, said first and said second interfaces each comprising a printed circuit board.

2. A modular jack receptacle as recited by claim 1, wherein said first interface is selectively removable from said housing.

3. A modular jack receptacle as recited by claim 1, wherein said housing includes a guide for receiving said second interface.

4. A modular jack receptacle as recited by claim 3, wherein said guide includes an interface retainer.

5. A modular jack receptacle as recited by claim 4, wherein said interface retainer comprises a first part provided integral with said housing, and a second part provided integral with said second interface and complementary with said interface retainer first part.

6. A modular jack receptacle as recited by claim 1, wherein said first connector comprises a terminal and a circuit trace connected thereto.

7. A modular jack receptacle as recited by claim 1, wherein said first interface further comprises electronic circuitry.

8. A modular jack receptacle as recited by claim 1, wherein said second connector comprises a terminal and a circuit trace connected thereto, said second connector terminal contacting said circuit trace of said first interface when said second interface is placed within said housing.

9. A modular jack receptacle as recited by claim 8, wherein said second interface further comprises electronic circuitry.

10. A modular jack receptacle as recited by claim 1, further comprising a third interface removably placeable in said housing and including a third connector for making an electronic connection to said second connector when said third interface is placed within said housing.

11. A modular jack receptacle as recited by claim 10, wherein said third interface comprises a printed wiring board and wherein said third connector comprises a terminal and a circuit trace connected thereto.

12. A modular jack receptacle as recited by claim 8, wherein said third interface comprises a printed wiring board and wherein said third connector comprises a terminal and a circuit trace connected thereto, said third connector terminal contacting said circuit trace of said second interface when said third interface is placed within said housing.

13. A modular jack receptacle as recited by claim 10, wherein said third interface further comprises electronic circuitry.

14. A modular jack receptacle as recited by claim 1, wherein said second interface further comprises an external connector for connecting an external device with said second interface.

15. A modular jack receptacle as recited by claim 10, wherein said third interface further comprises an external connector for connecting an external device with said third interface.

16. A system for evaluating a communication line provided between a central office (CO) and a customer premise location, the CO including communications equipment for communicating a signal from the CO to the customer premise location over the communications line, said system comprising:

a modular jack receptacle adapted to accept and hold a modular jack including a terminal and located at the customer premise location and connected to the communication line, said modular jack receptacle comprising:

a housing having an aperture for accepting the modular jack;

a first interface provided in said housing and including a first connector for making an electronic connection to the modular jack terminal when the modular jack is held within said modular jack receptacle; and a second interface removably placeable in said housing and including a second connector for making an electronic connection to the modular jack terminal via said first connector when said second interface is placed within said housing, said second interface further comprising receiving and communicating means for receiving the signal communicated from the CO and for communicating a return signal to the CO in response to the received signal, said first and said second interfaces each comprising a printed circuit board.

17. A system as recited by claim 16, wherein said receiving and communicating means comprises a maintenance test unit.

18. A system as recited by claim 17, wherein said maintenance test unit is adapted to detect an open circuit condition in the communications line.

19. A system as recited by claim 16, wherein said receiving and communicating means comprises a half-ringer.

20. A system as recited by claim 16, wherein said first interface is selectively removable from said housing.

21. A system as recited by claim 16, wherein said housing includes a guide for receiving said second interface.

22. A system as recited by claim 21, wherein said guide includes an interface retainer.

23. A system as recited by claim 22, wherein said interface retainer comprises a first part provided integral with said housing, and a second part provided integral with said second interface and complementary with said interface retainer first part.

24. A system as recited by claim 16, wherein said first connector comprises a terminal and a circuit trace connected thereto.

25. A system as recited by claim 16, wherein said first interface further comprises electronic circuitry.

26. A system as recited by claim 24, wherein said second connector comprises a terminal and a circuit trace connected thereto, said second connector terminal contacting said circuit trace of said first interface when said second interface is placed within said housing.

27. A system as recited by claim 26, wherein said second interface further comprises electronic circuitry.

28. A system as recited by claim 16, further comprising a third interface removably placeable in said housing and including a third connector for making an electronic connection to said second connector when said third interface is placed within said housing.

29. A system as recited by claim 28, wherein said third interface comprises a printed circuit board and wherein said third connector comprises a terminal and a circuit trace connected thereto.

30. A system as recited by claim 26, wherein said third interface comprises a printed circuit board and wherein said third connector comprises a terminal and a circuit trace connected thereto, said third connector terminal contacting said circuit trace of said second interface when said third interface is placed within said housing.

31. A system as recited by claim 28, wherein said third interface further comprises electronic circuitry.

32. A system as recited by claim 16, wherein said second interface further comprises an external connector for connecting an external device with said second interface.

33. A system as recited by claim 28, wherein said third interface further comprises an external connector for connecting an external device with said third interface.

34. A modular jack receptacle for receiving and holding a modular jack having a terminal, said modular jack receptacle comprising a plurality of selectively removable and interconnectable interfaces, each of said plurality of interfaces comprising a printed circuit board and including a connector for making an electronic connection between adjacent ones of said plurality of interfaces, said connector for one of said plurality of interfaces making an electronic connection to the modular jack terminal, said other ones of said plurality of interfaces being connectable to the modular jack terminal via said respective connector and said one of said interfaces.

* * * * *